US007014297B2

(12) United States Patent
Miki et al.

(10) Patent No.: US 7,014,297 B2
(45) Date of Patent: Mar. 21, 2006

(54) INK JET HEAD HAVING OVAL-SHAPED ORIFICES

(75) Inventors: Motoharu Miki, Hachioji (JP); Kaoru Horie, Hachioji (JP); Masanobu Shimizu, Hachioji (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 10/831,402

(22) Filed: Apr. 23, 2004

(65) Prior Publication Data

US 2004/0196332 A1 Oct. 7, 2004

Related U.S. Application Data

(63) Continuation of application No. 10/108,143, filed on Mar. 27, 2002, now abandoned.

(30) Foreign Application Priority Data

Mar. 30, 2001 (JP) ..... 2001-102329
Sep. 12, 2001 (JP) ..... 2001-276922

(51) Int. Cl.
*B41J 2/14* (2006.01)
*B41J 2/16* (2006.01)
*B41J 2/045* (2006.01)

(52) U.S. Cl. ..... 347/47; 347/347; 347/68

(58) Field of Classification Search ..... 347/15, 347/20, 40, 44, 47, 56, 63, 65, 67, 68, 70, 347/61

See application file for complete search history.

(56) References Cited

U.S. PATENT DOCUMENTS 6,084,609 A * 7/2000 Manini et al. ..... 347/40
6,557,974 B1 * 5/2003 Weber ..... 347/47

FOREIGN PATENT DOCUMENTS

JP 06-316083 A 11/1994

* cited by examiner

*Primary Examiner*—Juanita D. Stephens
(74) *Attorney, Agent, or Firm*—Frishauf, Holtz, Goodman & Chick, P.C.

(57) ABSTRACT

An ink head includes an ink head module and a nozzle plate. The ink head module has a plurality of ink chambers in which ink is retained. The nozzle plate is attached to the ink head module. The nozzle plate has at least one nozzle to jet ink inside the ink chamber. The surface of the nozzle plate opposing to a recording medium has a first region coming in contact with an opening of the nozzle and a second region other than the first region. Water repellency of the first region is higher than that of the second region.

3 Claims, 10 Drawing Sheets

INK JET HEAD HAVING OVAL-SHAPED ORIFICES

CROSS-REFERENCE TO RELATED APPLICATIONS

This is a continuation of U.S. application Ser. No. 10/108,143 filed Mar. 27, 2002 now abandoned, which application is based upon and claims the benefit of priority from the prior Japanese Patent Application No. 2001-102329, filed Mar. 30, 2001, and Japanese Patent Application No. 2001-276922, filed Sep. 12, 2001, the entire contents of both of which are incorporated herein by reference.

BACKGROUND OF THE INVENTION

1. Field of the Invention

The present invention relates to an ink head to be mounted to an ink jet printer.

2. Description of the Related Art

There have been known various types of image recording apparatuses. In recent years, the ink jet printers adopting an ink jet recording system as the image recording apparatus have come into wide use. The reason why is because the ink jet printers are relatively low-priced and small-sized.

There are various kinds of ink jet printers. For example, the ink jet printer has an ink head. Alternatively, the ink jet printer has an ink head and a moving mechanism. Alternatively, the ink jet printer has an ink head, a moving mechanism and a conveying mechanism.

The ink head jets ink toward a recording medium in which an image is recorded. The moving mechanism moves the ink head relative to the recording medium. The conveying mechanism moves the recording medium relative to the ink head.

The ink head has an ink head module and a nozzle plate. The ink head module has a longitudinal central axis. The ink head module has a plurality of ink chambers which are arranged so as to be separated from one another at predetermined pitches along the longitudinal central axis thereof. The nozzle plate is arranged on the surface (front surface) of the ink chamber opposing to the recording medium.

The nozzle plate has nozzles, which allow ink to pass through each of the plurality of ink chambers. Each ink chamber has known jetting energy generating means such as, for example, a piezo element. The jetting energy generating means applies a force necessary for jetting to ink at the time of ink jetting. Each ink chamber has known jetting energy generating means (jetting energy element), thereby an ink droplet can be jetted from the nozzle.

The above described ink jet printer intermittently conveys the recording medium by driving of the conveying mechanism. During the intermittent conveying operation, the ink jet printer drives the ink head while the recording medium is at a standstill. At the same time, the ink jet printer jets the ink droplet from a plurality of nozzles. By these operations, the ink jet printer records a desired image on the recording medium. That is, the ink jet printer puts the ink jetted from the nozzle on the recording medium. The ink jet printer forms an image by this putted ink.

As described above, the ink jet printer records an image by jetting ink from the nozzle. Accordingly, when a flying direction of the jetted ink droplet changes from a desired direction, the ink droplet puts on a position, which is deviated from a predetermined putting position on the recording medium. When the flying direction changes as described above, the jetted ink droplet sometimes coalesces into the ink droplet jetted from the adjacent nozzle during the flying. In this case, the recorded image is deteriorated in quality.

In the ink head, the ink droplet sometimes puts on the front surface of the nozzle plate. For example, the ink droplet jetted from the nozzle and/or the ink droplet jetted/sucked after the maintenance work of the ink head puts on the front surface of the nozzle plate.

The ink droplet put on the front surface is referred to as "put-ink-droplet" in the present specification. The put-ink-droplet stays in the vicinity of a nozzle opening. For this reason, the put-ink-droplet has a risk of being brought into contact with the ink to be jetted from the nozzle. When the ink to be jetted is brought into contact with the put-ink-droplet, a remarkable deviation occurs in the flying direction of the jetted ink droplet. That is, the jetted ink droplet causes a flying deflection. For this reason, there are available those ink heads, which have the nozzle plate subjected to water repellent process on the entire surface so that the put-ink-droplet does not stay in the vicinity of the nozzle opening. However, when such a water repellent process is applied to the front surface of the nozzle plate, it is easy for the put-ink-droplet to move on the front surface. Accordingly, the put-ink-droplet moves to the vicinity of the opening of the nozzle. And the put-ink-droplet moves to the vicinity of the opening of the other nozzle than the nozzle. For this reason, the put-ink-droplet in the vicinity of the opening and the ink to be jetted have a possibility of coming in contact with each other. In this way, even when the water repellent process is applied to the entire surface of the front surface of the nozzle plate, the ink head still has a possibility that the jetted ink droplet causes the flying deflection.

In recent years, the ink jet printers have been expected to speed up the image forming speed and highly increase the density of recording density. Hence, the ink head has a plurality of nozzles for each ink chamber. Such an ink jet printer can increase the number of nozzles without increasing the number of ink chambers. Accordingly, such an ink jet printer can enhance the recording density. However, in such an ink head, when there is an irregularity in accuracy for making nozzle, it is difficult to arrange each nozzle 131 ideally as shown in FIG. 9A.

For example, an ink head 110 shown in FIGS. 10A and 10B, has two each nozzle 131 for each ink chamber 120. These nozzles 131 have a front-surface-opening, which is an opening at the front surface side of the nozzle plate, and a rear-surface-opening which is an opening at the ink chamber side. Each nozzle 131 is formed closely to the adjacent nozzle 131. Therefore, when there is an irregularity in the accuracy for making nozzle, a portion of the rear-surface-opening of one nozzle 131 and a portion of the rear-surface-opening of the other adjacent nozzle 131 overlap with each other. Each nozzle 131, as shown in FIGS. 11A and 11B, sometimes has a portion of the rear-surface-opening overlapped with side walls 121. In this way, each nozzle 131 interferes with the other nozzle and the side wall as shown in FIG. 10B and FIG. 11B. As a result, two ink droplets 80 jetted from the ink head 110 cannot jet in a desired jetting direction. In other words, the ink droplet to be jetted from the ink head 110 causes the flying deflection. Therefore, the two ink droplets 80 have a risk of being not put on a desired position on the recording medium. Further, the two ink droplets 80 have a risk of coalescing with each other during the flying. Note that, ideally speaking; the two ink droplets fly without coalescing with each other as shown in FIG. 9B.

BRIEF SUMMARY OF THE INVENTION

The present invention solves the above described troubles and its object is to provide an ink head wherein a flying deflection is hard to occur on an ink droplet to be jetted.

In order to solve the troubles and achieve the object, the ink head according to the present invention is configured as follows.

An ink head according to one aspect of the present invention is used for an ink jet printer which forms an image by jetting an ink droplet toward a recording medium and putting the ink droplet on the recording medium. This ink head comprises an ink head module and a nozzle plate. The ink head module has a plurality of ink chambers in which ink is retained. The nozzle plate is attached to the ink head module. This nozzle plate has nozzles to jet ink inside the ink chamber. The surface of the nozzle plate opposing to the recording medium has a first region coming in contact with an opening of the nozzle and a second region other than the first region. The water repellency of the first region is higher than that of the second region.

Further, an ink head according to another aspect of the present invention comprises ink chambers, jetting energy elements and nozzles. The ink chambers are arranged at predetermined intervals. The jetting energy elements are provided for each ink chamber. This jetting energy element applies a jetting energy to ink inside the ink chamber. The nozzle is provided so as to communicate with the ink chamber. The nozzles are provided in plurality for each ink chamber. Each nozzle has a rear-surface-opening, which is an opening opposite to the ink chamber. This rear-surface-opening is oval-shaped. Each nozzle is arranged such that a minor axial direction of the oval-shaped opening is parallel to the minor axial direction of a nozzle adjacent thereto.

Further, an ink head according to another aspect of the present invention comprises ink chambers, jetting energy elements and nozzles. The ink chambers are arranged at predetermined intervals. The jetting energy elements are provided for each ink chamber. This jetting energy element applies a jetting energy to ink inside the ink chamber. The nozzle is provided so as to communicate with the ink chamber. These nozzles are provided in plurality for each ink chamber. The ink chamber is formed so that a region of the section orthogonal to a flowing direction of the ink flowing inside the ink chamber is larger in the vicinity of the nozzle than the center along a direction in which the ink flows.

Further, an ink jet head according to another aspect of the present invention comprises ink chambers, jetting energy elements and nozzles. The ink chambers are arranged at predetermined intervals. The jetting energy elements are provided for each ink chamber. This jetting energy element applies a jetting energy to ink inside the ink chamber. The nozzle is provided so as to communicate with the ink chamber. The nozzles are provided in plurality for each ink chamber. The ink chamber has four side walls such that a sectional shape of the ink chamber becomes a parallelogram when viewed from the nozzle direction. The plurality of nozzles are arranged along a substantially parallel direction to the diagonal line having a longer line segment of two diagonal lines of the parallelogram defined by the four side walls.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiment of the invention, and together with the general description given above and the detailed description of the embodiment given below, serve to explain the principles of the invention.

DETAILED DESCRIPTION OF THE INVENTION

Hereinafter, the embodiments of the present invention will be described with reference with the drawings.

(First Embodiment)

Figure 1A:
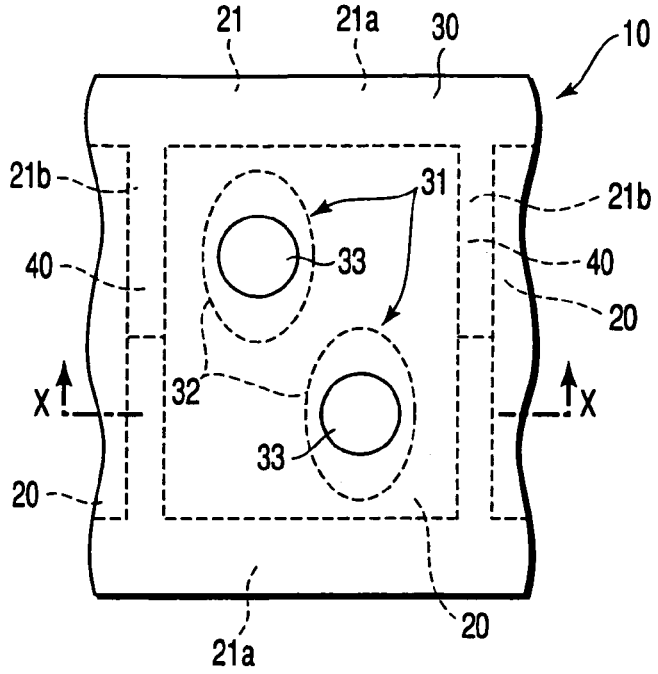
FIG. 1A is a top view showing a portion of an ink head according to a first embodiment of the present invention.
Figure 1B:
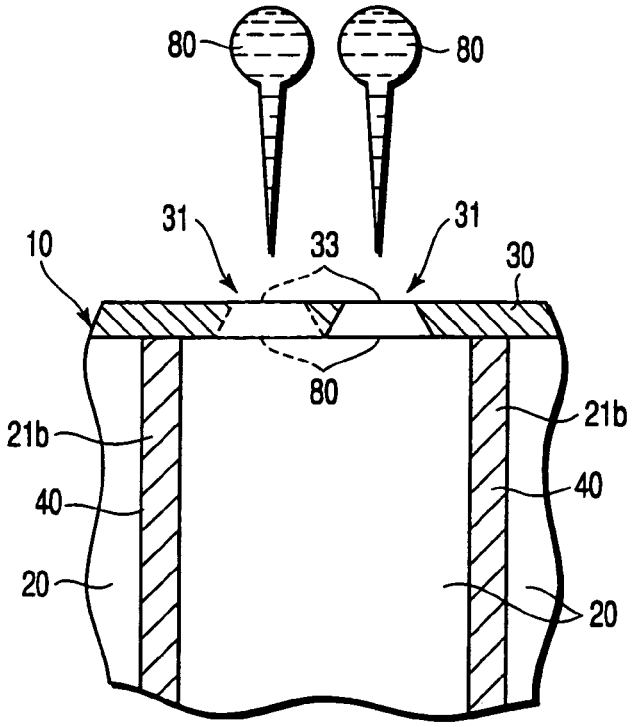
FIG. 1B is a sectional view taken along the line X—X in FIG. 1A.

First, an ink head 10 according to a first embodiment of the present invention will be described with reference to FIGS. 1A and 1B. FIG. 1A is a top view showing a portion of the ink head 10 according to the present embodiment. FIG. 1B is a sectional view cut along the line X—X in FIG. 1A.

The ink head 10 is mounted on a known image recording apparatus, and moves relatively to a recording medium on which an image is recorded in a main and sub-scanning direction, and performs the recording of the image by jetting ink.

The ink head 10, as shown in FIG. 1A, has a plurality of ink chambers 20, a nozzle plate 30 and jetting energy elements 40.

The plurality of ink chambers 20 are provided along a longitudinal central axis of the ink head 10 at predetermined pitches. Each ink chamber 20 is formed so as to be surrounded four side walls 21. Each ink chamber 20 has openings at both sides along a direction in which the side wall 21 extends. The one of the two openings is opposite to the recording medium at the image recording time. This one opening is covered with the nozzle plate 30. The other is covered with a bottom wall. This bottom wall is connected to an ink tank (not shown) in which the ink is stored. Note that, in the present specification, the opening covered with the nozzle plate 30 is defined as a plate-side-opening. Accordingly, the ink supplied from the ink tank flows from the bottom wall toward the plate-side-opening in the ink chamber. The direction from the bottom wall to the plate opening is designated as "flowing direction of the ink" in the present specification.

The four side walls 21 have a pair of side walls 21*a* and a pair of side walls 21*b*. The pair of side walls 21*a* is a pair of side walls 21 extending along an arranged direction of the ink chambers 20. The pair of side walls 21*b* is a pair of side walls 21*b* extending in a direction to intersect the pair of side walls 21*a*. The pair of side walls 21*b* has jetting energy elements 40. The interval between the pair of side walls 21*b* is configured narrower than that between the pair of side walls 21*a*.

The jetting energy element 40 is, for example, a piezoelectric driving element such as a piezo element. This jetting energy element 40 is a known energy generating element to apply a necessary force for ejecting ink at the time of ink jetting.

The nozzle plate 30 is the shape of a flat plate. The nozzle plate 30 has a front surface coming contact with the outside air and a rear surface opposing to the ink chamber 20. The nozzle plate 30 extends across the entire longitudinal central axis of the ink head 10 so as to cover the plate-side-openings of all the ink chambers 20. Further, the nozzle plate 30 has a plurality of nozzles 31 which communicates with the inside of each ink chamber 20 so as to allow the ink inside the ink chamber 20 to eject as the ink droplet. To be more specific, the nozzle plate 30 provides two pieces of the nozzle 31 for every ink chamber 20. A plurality of nozzles 31 are ejecting-openings when the ink is jetted on the recording medium.

The nozzle 31 has a rear-surface-opening 32, which is an opening of the rear surface in the nozzle plate 30, and a front-surface-opening 33, which is an opening of the front surface. The rear-surface-opening 32 is oval-shaped. The front-surface-opening 33 is formed with an area smaller than that of the rear-surface-opening 32. The front-surface-opening 33 is arranged so as to be coaxial with the rear-surface-opening 32.

The two nozzles 31 of each ink chamber 20 have the directions (minor axial direction) of the minor axis of the rear-surface-openings 32. The minor axial directions of the two nozzles 31 are parallel to each other. The two nozzles 31 are spaced apart along the minor axial direction. Further, the two nozzles 31 are arranged so as to shift to a direction orthogonal to the minor axial direction (major axial direction). The minor axial direction of the two nozzles 31 is made parallel to the arrangement direction (left and right directions in the drawing) of the side walls of the pair of side walls 21*b*.

As shown in the above described composition, the two nozzles 31 have the rear-surface-openings 32 formed in an oval shape. For this reason, the rear-surface-openings 32 are made smaller in the dimension of the minor axial direction in contrast to the case where the rear-surface-openings are formed in the circular shape having the same area. Accordingly, the interval between the two nozzles 31 along the minor axial direction can be made larger in contrast to the case where the circular shape having the same area is formed. The interval between each nozzle 31 and the side wall 21 can be also made larger.

Further, as shown in the above described composition, the minor axial directions of the two nozzles 31 coincide with the arrangement direction of the pair of the side walls 21*b*. For this reason, even if the nozzles are incidentally located side-by-side along the narrow interval defined by the pair of the side walls, the nozzles will not overlap with each other or with any one of the side walls.

Further, as shown in the above described composition, the two nozzles 31 are arranged so as to shift toward a minor axial direction and a longitudinal direction. The two nozzles 31 are formed in the oval shape as described above. Accordingly, the two nozzles 31 are formed smaller in the dimension in the minor axial direction in contrast to the case where they are formed in the circular shape having the same area. For this reason, the two nozzles 31 can make the interval between themselves larger along the minor axial direction and the longitudinal direction in contrast to the case where the rear-surface-opening 32 is formed in the circular shape as described above. That is, the two nozzles 31 can be prevented from overlapping with the adjacent nozzle and the side wall.

Accordingly, even when irregularity exists in the accuracy for making each nozzle when a plurality of nozzles are formed in each chamber 20, the ink head 10 separates each nozzle from a nozzle adjacent thereto at predetermined intervals. And each nozzle can be arrange so as to separate from the side wall also.

Figure 2A:
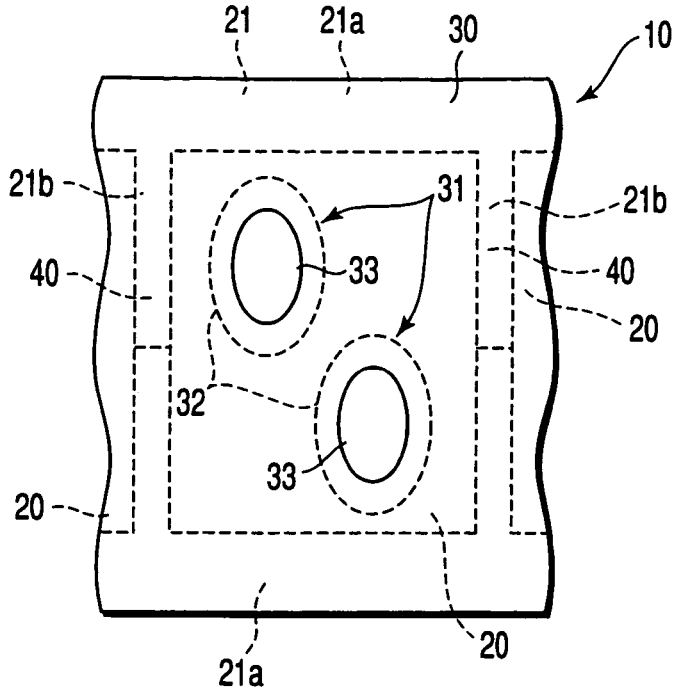
FIG. 2A is a top view showing a modification of the ink head according to the first embodiment.

Further, each nozzle 31 has the front-surface-opening 33 formed in the circular shape. As shown in FIG. 2A, it can be also formed in the oval shape so that the minor axial and the major axial directions of the rear-surface-opening coincide with each other. In this case, each nozzle can be easily fabricated since the shapes of the rear-surface-opening 32 and the front-surface-opening 33 are the same.

Figure 2B:
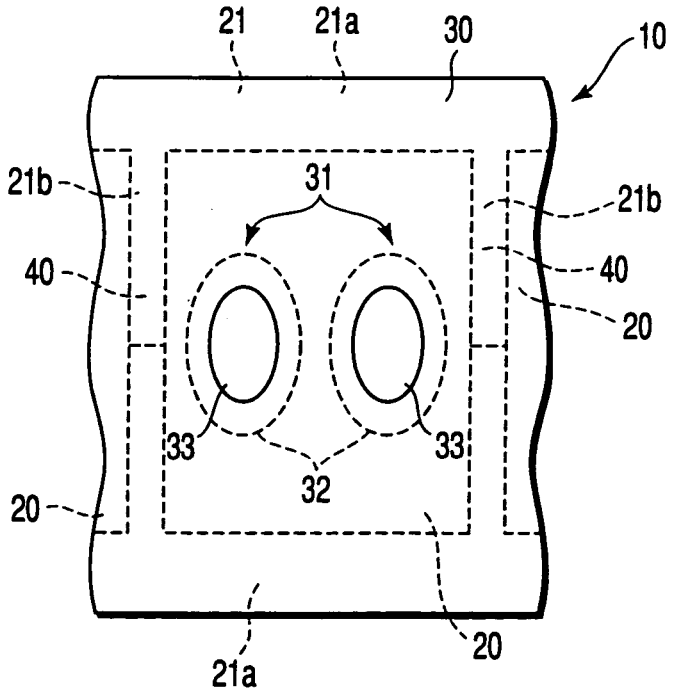
FIG. 2B is a top view showing a modification of the ink head according to the first embodiment.

Note that the two nozzles 31 are not limited to be arranged mutually shifted along the major axial direction as described above if they can jet the ink droplet to a desired position. For example, the two nozzles 31, as shown in FIG. 2B, can be arranged such that the minor axial directions thereof are on a straight line. In this case also, since the two nozzles 31 have the rear-surface-openings 32 formed in the oval shape, the interval between themselves can be made larger in contrast to the case where the rear-surface-openings 32 are formed in the circular shape.

Although each nozzle 31 according to the present embodiment has the front-surface-opening 33 formed in the circular shape, its shape is not limited if it can jet the ink droplet to a desired position.

Note that, in the present embodiment, though the ink head 10 is configured so as to have two nozzles 31 for each ink chamber 20, it can be configured so as to have more than two nozzles 31. In this case also, if the rear-surface-opening 32 is the oval shape, each nozzle 31 is formed smaller in the dimension in the minor axial direction in contrast to the case where the rear-surface-opening is configured by the circular shape having the same area with the rear-surface-opening 32. For this reason, a plurality of nozzles 31 can make the intervals for the adjacent nozzles 31 and the side walls 21 larger in contrast to the case where the rear-surface-openings 32 are formed in the circular shape. Accordingly, even when irregularity exists in the accuracy for making each nozzle when a plurality of nozzles are formed in each chamber 20, the ink head 10 separates each nozzle from a nozzle adjacent thereto at a predetermined interval and can arrange each nozzle so as to separate from the side wall also.

(Second Embodiment)

Figure 3:
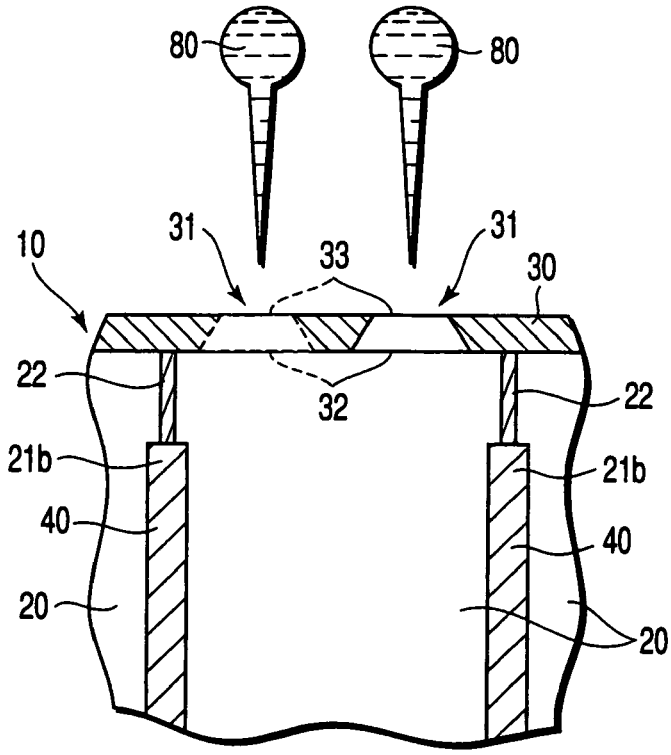
FIG. 3 is a sectional view showing a portion of an ink head according to a second embodiment of the present invention.

Hereinafter, an ink head 10 according to a second embodiment of the present invention will be described with reference to FIG. 3. Note that, in the present embodiment, the same component members as the ink head 10 according to the first embodiment of 10 the present invention use the same reference numerals to designate the same component members of this ink head 10 and the detailed description thereof will be omitted. FIG. 3 is a sectional view showing a portion of the ink head 10 according to the present embodiment.

The ink head 10 according to the present embodiment is different from the first embodiment in the composition of a pair of side walls 21*b*. The ink head 10 according to the present embodiment, as shown in FIG. 3, has a thin portion 22 in the vicinity of the nozzle. The thin portion 22 is thinner than a center in the direction along the longitudinal central axis (up and down direction in FIG. 3) of the side walls 21*b*. In other words, the ink head 10 has a thin portion 22 thinner than the center along the direction along the ink flowing direction. For this reason, the ink chamber 20 is formed such that the area of the section orthogonal to the ink flowing direction is larger in the vicinity of the nozzle than the center along the ink flowing direction.

The thin portion 22 is arranged nearly in the central portion in the direction (right and left direction in FIG. 3) orthogonal to the longitudinal central axis of the pair of side walls 21*b* in each side wall of the pair of side walls 21*b*. That is, the thin portion 22 is thinly formed so as to be caved in a little by equal distances to both side surfaces of each side wall 21*b*. The thin portion 22 is not provided with the jetting energy element 40 (for example, an electrode to apply voltage to the piezo element is not provided). The thin portion 22 is moved according to the operation of the pair of side walls 21*b* other than the thin portion 22.

By the above described composition, the ink chamber 20 has the thin portion 22. Thereby it can make the dimension along the arrangement direction larger in the vicinity of the nozzle without changing the dimension of the largest width of the side wall along the arrangement direction. In other words, since the ink chamber 20 has the thin portion 22, it can form the area in the vicinity of the nozzle larger than the area of the center of the longitudinal central axis in the section orthogonal to the longitudinal central core thereof.

Accordingly, even in the case where irregularity exists in the accuracy for making each nozzle 31 when two nozzles 31 are formed in each chamber 20, the ink head 10 separates each nozzle from a nozzle adjacent thereto at a predetermined interval. Each nozzle can be arranged so as to separate from the side wall also.

Note that, the ink head 10 according to the present embodiment is provided with the thin portion 22 only on the pair of side walls 21*b*. It is also possible to provide the thin portion 22 on the pair of side walls 21*a*. It is also possible to provide the thin portion 22 on both of the pair of side walls 21*a* and the pair of side walls 21*b*. In this case, since a possibility that each nozzle 31 comes in contact with the nozzle 31 adjacent thereto is further reduced. Even when irregularity exists in the accuracy for making nozzle the ink head 10 separates each nozzle from a nozzle adjacent thereto at a predetermined interval and can arrange each nozzle so as to separate from the side wall also.

Further, as described in the present embodiment, though the pair of side walls 21*b* is preferably formed so as to have the thin portions 22 on both side walls. It can be also formed so as to have the thin portion 22 on only one side of the side walls.

Though the thin portion 22 is configured so as to have a step to other portion of each side wall of the pair of side walls 21*b*. It can be formed in such a manner as to become gradually thinner from the other portion.

Note that, in the present embodiment, though the ink head 10 is configured so as to have two nozzles 31 for each ink chamber 20, it can be configured so as to have more than two nozzles 31. In this case also, the area in the vicinity of the nozzle can be made larger in contrast to the case without thin portion 22. For this reason, a plurality of nozzles 31 can make the intervals for the adjacent nozzles 31 and the side walls 21 larger in contrast to the case without thin portions 22. Accordingly, even in the case where irregularity exists in the accuracy for making each nozzle when a plurality of nozzles is formed in each chamber 20, the ink head 10 separates each nozzle from a nozzle adjacent thereto at a predetermined interval. Each nozzle can be arranged so as to separate from the side wall also.

(Third Embodiment)

Figure 4:
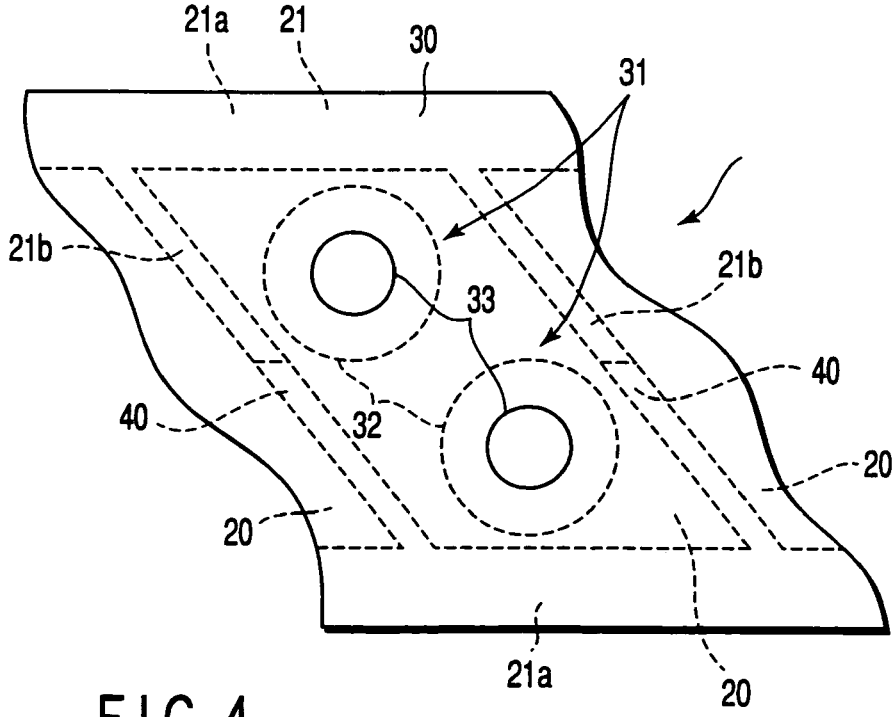
FIG. 4 is a top view showing a portion of an ink head according to a third embodiment of the present invention.

Hereinafter, an ink head 10 according to a third embodiment of the present invention will be described with reference to FIG. 4. Note that, in the present embodiment, the same component members as the ink head 10 according to the first embodiment of the present invention use the same reference numerals to designate the same component members of this ink head 10 and the detailed description thereof will be omitted. FIG. 4 is a sectional view showing the ink head 10 according to the present embodiment.

The ink head 10 according to the present embodiment is different from the first embodiment in the composition of the side wall 21. The ink head 10 according to the present embodiment has four side walls 21 arranged so as to be a parallelogram when viewed from the nozzle 31 side (nozzle direction). The two nozzles 31 arranged in each ink chamber 20 are arranged along a substantially parallel direction to the diagonal line having a longer line segment of the two diagonal lines of the parallelogram defined by the side wall 21.

The above described composition can make a length of the line segment connecting the centers of the two nozzles 31 larger in contrast to the case where the four side walls 21 are arranged so as to define a rectangle having the same area as the parallelogram when seen from the nozzle direction. Accordingly, even in the case where irregularity exists in the accuracy for making each nozzle 31 when two nozzles 31 are formed in each chamber 20, the ink head 10 separates each nozzle 31 from the nozzle 31 adjacent thereto at a predetermined interval. Each nozzle can be arranged so as to separate from the side wall also.

Note that, in the present embodiment, the ink head 10 is configured so as to have two nozzles 31 for each ink chamber 20. It can be configured so as to have more than two nozzles 31. In this case also, the length of the line segment connecting the centers of the nozzles 31 arranged in each ink chamber 20 can be made larger in contrast to the case where the side wall 21 defines the rectangle. Accordingly, even in the case where irregularity exists in the accuracy for making each nozzle 31 when a plurality of nozzles 31 is formed in each chamber 20, the ink head 10 according to the present embodiment separates each nozzle from a nozzle adjacent thereto at a predetermined interval. Each nozzle can be arranged so as to separate from the side wall also.

(Fourth Embodiment)

Figure 5A:
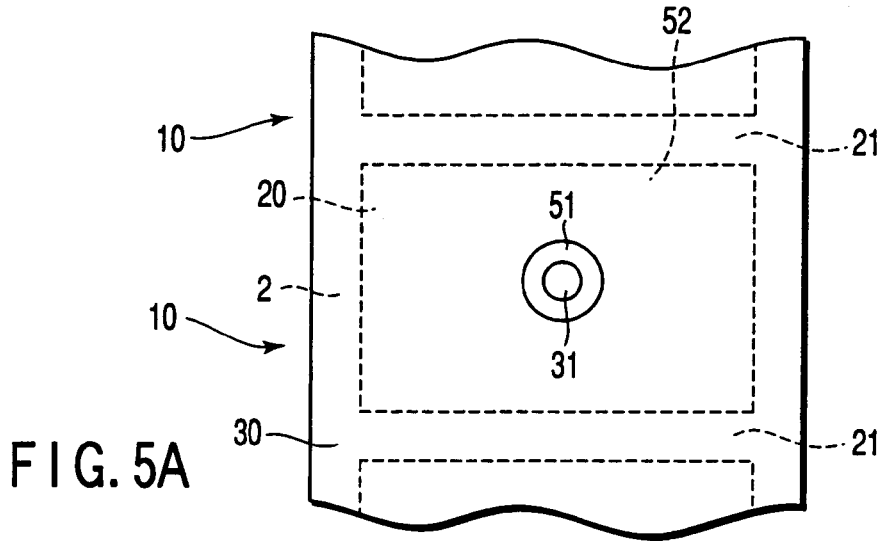
FIG. 5A is a top view showing an ink head according to a fourth embodiment of the present invention.
Figure 5B:
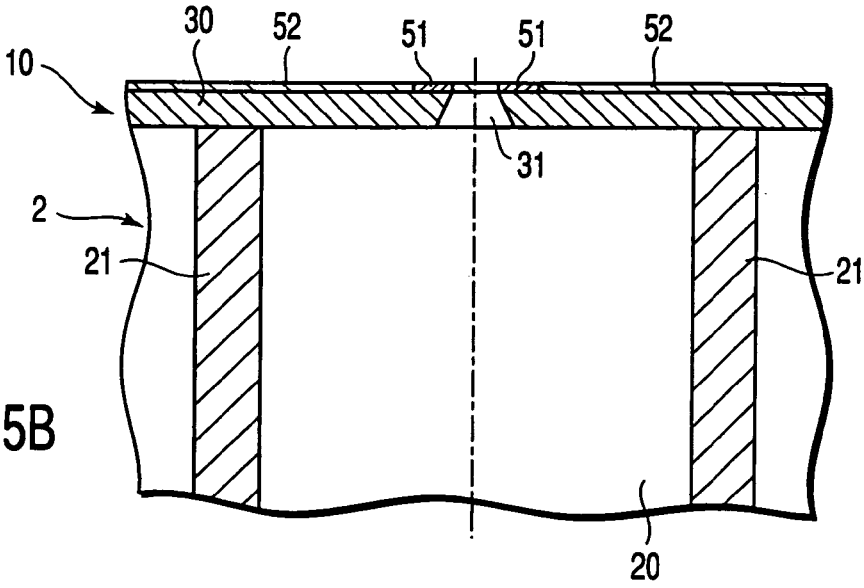
FIG. 5B is a sectional view showing the ink head in FIG. 5A.
Figure 5C:
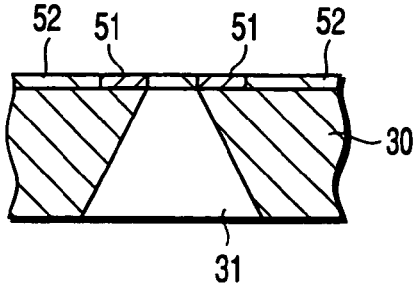
FIG. 5C is an enlarged sectional view showing first and second regions of FIG. 5B.

First, an ink jet printer 1 according to a fourth embodiment of the present invention will be described with reference to FIGS. 5A to 5C. Note that, in the present embodiment, the same component members as the ink head 10 according to the first embodiment of the present invention use the same reference numerals to designate the same component members of this ink head 10 and the detailed description thereof will be omitted. FIG. 5A is a top view showing the ink head 10 according to the present embodiment. FIG. 5B is a sectional view showing the ink head 10 of FIG. 5A. FIG. 5C is an enlarged sectional view to explain the nozzle of FIG. 5B.

Similarly to the first embodiment, the ink head 10 is mounted on a known ink jet printer and performs image recording.

The ink head 10 has an ink head module 2 having a plurality of ink chambers 20 and a nozzle plate 30 which provides nozzles 31 on the front surface of each ink chamber 20. The front surface is opposite to a recording medium.

The ink head module 2 is provided with a plurality of ink chambers 20 along the longitudinal direction thereof at predetermined pitches. The ink head module 2 is connected to an ink tank (not shown) inside the ink jet printer via a tube (not shown), which is a liquid path, so that the ink can be supplied to each ink chamber 20. The ink head module 2 has the same energy generating element as that of the first embodiment. Each ink chamber 20 has a pair of opposing side walls 21 configured by the driving portion of the energy generating element. Each ink chamber 20 is configured so as to be able to jet ink from the front surface via the nozzle 31.

The nozzle plate 30 is formed in a flat shape similarly to the first embodiment. The ink is inside the ink chamber 20. The nozzle plate 30 provides the nozzle 31 for each ink chamber 20 to allow the ink to jet as an ink droplet. However, the front surface of the nozzle plate 30 according to the present embodiment has a fist region 51 and a second region 52. The first regions are arranged for each nozzle. Note that the second region is a region other than the first region 51.

The first region 51 coaxially extends from the portion coming in contact with the opening of each nozzle 31 to the opening of each nozzle 31. In other words, the first region 51 is in the shape of a doughnut. Further in other words, the first region 51 have a circular region, the nozzle 31 is arranged in the center of the circular region.

The second region 52 is a region arranged extending across the entire front surface of the nozzle plate other than the first region. The second region 52 surrounds the first region 51.

The first and second regions 51, 52 are coated with materials having different water repellency, respectively on the nozzle plate 30 with the substantially same thickness. Note that, in the present specification, the "water repellency" designates a capacity to repel known liquid state ink.

The material used for the coating is selected in such a manner that the first region 51 has higher water repellency than that of the second region 52. For example, the first region 51 uses Polyflon (trademark) having about 0.02 of coefficient of friction so that the first region has higher water repellency than that of the second region. The second region uses Teflon (trademark) having about 0.05 of-coefficient of friction. The material which coats the first region 51 has high water repellency for the ink. Note that the material which coats the first region 51 preferably has a small surface tension with respect to the surface tension of the ink.

Hereinafter, a case where the ink droplet puts on the front surface of the nozzle plate 30 will be described.

The case where the ink droplet after having been jetted first puts on the first region 51 will be described. The first region 51 has high water repellency to the ink. For this reason, the ink droplet put on this nozzle plate, that is, the put-ink-droplet does not stay in the first region 51. That is, the put-ink-droplet does not stay in the vicinity of the opening of the nozzle 31. The put-ink-droplet moves to the second region 52 or the nozzle 31. Because of a difference in the water repellency, the put-ink-droplet does not return again to the first region 51. That is, the put-ink-droplet does not return again to the vicinity of the opening of the nozzle 31, but stays in the second region 52. Or, the put-ink-droplet moves to the second region and is excluded from the front surface of the nozzle plate 30.

Subsequently, the case where the ink droplet after having been jetted first puts on the second region will be described. The put-ink-droplet of the second region 52, as described above, stays in the second region 52 or moves on the second region 52. The put-ink-droplet of the second region 52 is excluded from the front surface of the nozzle plate 30.

Accordingly, the ink head 10 according to the present embodiment can prevent the put-ink-droplet from staying in the vicinity of the opening of the nozzle 31. Accordingly, the ink head 10 can prevent the flying deflection of the ink droplet due to the put ink-droplet put on the front surface.

Note that, in the present embodiment, the first region 51 is coaxially with the opening of each nozzle 31 from the portion coming in contact with the opening of each nozzle 31. This first region 51 is not limited in its shape, if only the first region can be configured in a continuous region in such a manner that it can cover the periphery of the opening of each nozzle 31 so as not to retain the put-ink-droplet inside the first region.

Note that, in the present embodiment, the first region 51 is configured in such a manner that the width of the first region from the center of the opening of each nozzle 31 is constant. That is, width of the first region 51 from the edge portion of the nozzle opening to the second region is the same at any place. In the present embodiment, since the opening of the nozzle 31 has a circular shape, the first region is a region coaxially extending. For example, in the case where the opening of the nozzle 31 has an oval shape, the width of the first region is configured so as to be constant at any place.

By constituting in this way, a distance to the second region 52 from any position of the periphery of the opening of the nozzle 31 is the same. Therefore the ink droplet can be moved more stably to the opening of the second region 52 or the opening of the nozzle 31.

Further, in the present embodiment, for the first region 51, Polyflon (trademark) having about 0.02 of coefficient of friction is used as a coating material, and, for the second region 52, Teflon (trademark) having about 0.05 of coefficient of friction is used as the coating material. If the first region 51 can be configured to have water repellency higher than that of the second region 52, the material is not limited. Further, the first region 51 and the second region 52 can be selected from materials having different coefficient of frictions. The first region 51 and the second region 52 can be selected from materials having different surface energies. In addition, the first region 51 and the second region 52 can be selected from materials having different surface tensions, and it is not limited in material selection reference.

Further, in the present embodiment, the first region 51 and the second region 52 are configured by being coated on the front surface of the nozzle plate 30. However, if the materials which constitute the first and second regions are selected so that the first region 51 becomes higher than the second region 52 in the water repellency, the following composition is possible. For example, it is possible that the member formed as a separate body from the nozzle plate 30 by the selected material is attached to the front surface of the nozzle plate 30, so that the first and second regions can be configured. It is also possible that one of the first and second regions is configured by the nozzle plate 30 and the other region is coated or attached with the separate body, so that the first and second regions can be configured.

(Fifth Embodiment)

Figure 6A:
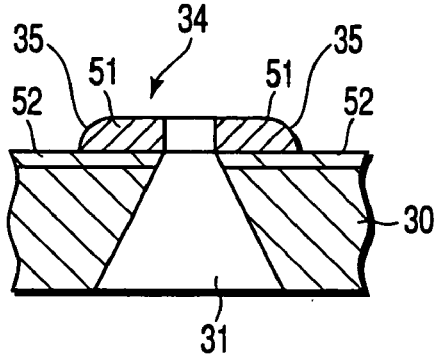
FIG. 6A is an enlarged sectional view showing first and second regions of an ink head according to a fifth embodiment of the present invention.

Hereinafter, an ink head 10 according to a fifth embodiment of the present invention will be described with reference to FIG. 6A. Note that, in the present embodiment, the same component members as the ink head 10 according to the fourth embodiment of the present invention use the same reference numerals to designate the same component members of this ink head 10 and the detailed description thereof will be omitted. FIG. 6A is an enlarged sectional view showing first and second regions 51, 52 of the ink head 10 according to the present embodiment.

A nozzle 31 has a nozzle front-end portion 34 arranged on the front surface of a nozzle plate 30. The ink head 10 according to the present embodiment has the second region 52 configured by a coating coated across the entire front surface of the nozzle plate 30 and the first region configured by the nozzle front-end portion 34.

The nozzle front-end portion 34 is configured by a material having water repellency higher than that of the second region 52. The nozzle front-end portion 34 has an opening to communicate with an ink chamber 20. Note that, in the present embodiment, the opening of the nozzle 31 coincides with the opening of the nozzle front-end portion 34. The nozzle front-end portion 34 is arranged on the second region 52. For this reason, the first region 51 protrudes further than the second region 52 toward an ink jetting direction. The nozzle front-end portion 34 has the portion coming in contact with the opening of the nozzle 31. The portion is highest with respect to the second region 52. Further, the nozzle-end portion 34 has a corner 35 which is rounded, where the front surface intersects with the side surface orthogonal to the front surface.

As shown in the above described composition, the first region 51 protrudes toward the ink jetting direction in comparison with the second region. For this reason, the ink droplet having moved from the first region 51 to the second region 52, will hardly move back to the first region 51. Further, since the corner 35 is rounded, it is difficult for the ink droplet to stay on the corner 35. Accordingly, this ink head 10 can prevent the put-ink-droplet from staying in the region 51.

Hereinafter, a modification of the ink head 10 of the present embodiment will be described.

(First Modification)

Figure 6B:
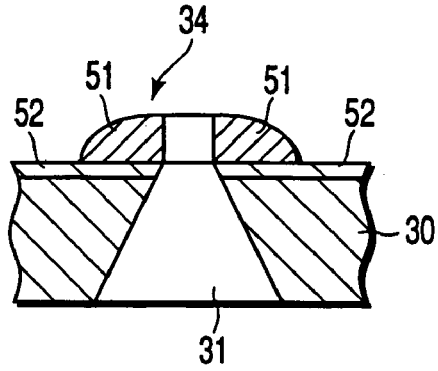
FIG. 6B is an enlarged section view showing a modification of the first and second regions of the ink head according to the fifth embodiment.

A first modification of the ink head 10 of the present embodiment is shown in FIG. 6B. A nozzle front-end portion 34 of the present modification has the front surface formed in a bent curved shape. The front surface descends toward the boundary between it and the second region 52 from the portion coming in contact with the opening of the nozzle. Further, the nozzle front-end portion 34 has the portion coming in contact with the opening of the nozzle 31. The portion protrudes highest in comparison with the second region.

As shown in the above-described composition, the first region 51 protrudes toward the ink jetting direction in comparison with the second region. For this reason, the ink droplet having moved from the first region 51 to the second region 52 will hardly move back to the first region 51. Since the first region 51 does not have a corner, it can prevent the put-ink-droplet from staying in the first region 51.

(Second Modification)

Figure 6C:
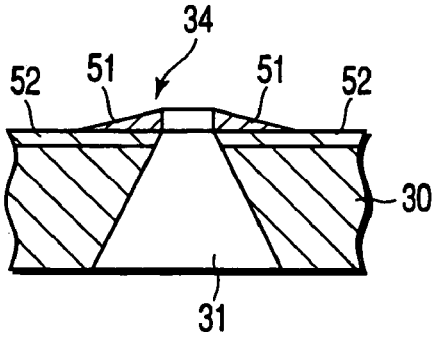
FIG. 6C is an enlarged section view showing a modification of the first and second regions of the ink head according to the fifth embodiment.

A second modification of the ink head 10 of the present embodiment is shown in FIG. 6C. A nozzle front-end portion 34 of the present modification has the front surface formed in the shape of an acute angle inclined surface with respect to the second region 52. The front surface descends toward the boundary between it and the second region 52 from the portion coming in contact with the opening of the nozzle. That is, the first region 51 is tapered toward the second region 52. Further, the nozzle-end portion 34 has the portion coming in contact with the opening of the nozzle. The portion protrudes highest in comparison with the second region.

As shown in the above described composition, the first region 51 protrudes toward the ink jetting direction in comparison with the second region. For this reason, the ink droplet having moved from the first region 51 to the second region 52, will hardly move back to the first region 51. Since the first region 51 does not have a corner, it can prevent the put-ink-droplet from staying in the first region 51.

(Third Modification)

Figure 6D:
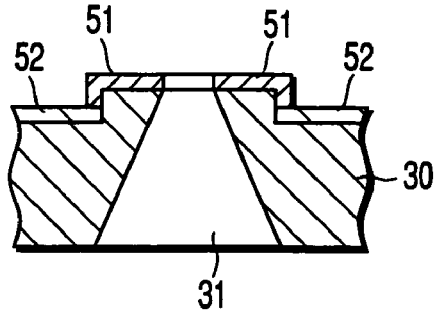
FIG. 6D is an enlarged section view showing a modification of the first and second regions of the ink head according to the fifth embodiment.

A third modification of the ink head 10 of the present embodiment is shown in FIG. 6D. A nozzle plate 30 of the present modification is formed by protruding toward the ink jetting direction. The first region 51 is in the protruded portion of the nozzle plate 30. The first region 51 is coated with a material higher in water repellency than that of the second region.

As shown in the above described composition, the first region 51 protrudes toward the ink jetting direction in comparison with the second region. For this reason, the ink droplet having moved from the first region 51 to the second region 52, will hardly move back to the first region 51. The ink head 10 can be made simple in the composition since it has no need for the nozzle front-end portion 34.

(Sixth Embodiment)

Figure 7A:
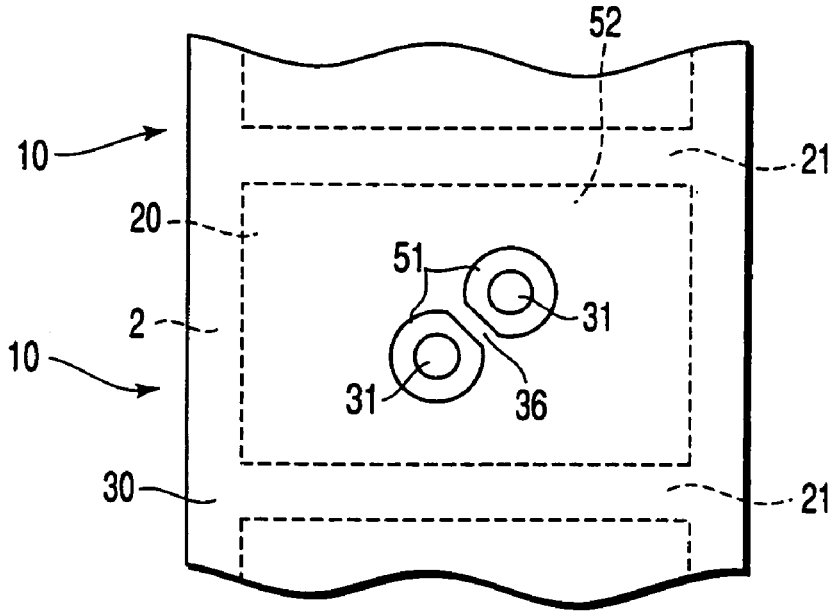
FIG. 7A is a top view showing an ink head according to a sixth embodiment of the present invention.

Hereinafter, an ink head 10 according to a six embodiment of the present invention will be described with reference to FIG. 7A. Note that, in the present embodiment, the same component members as the ink head 10 according to the fourth embodiment of the present invention use the same reference numerals to designate the same component members of this ink head 10 and the detailed description thereof will be omitted. FIG. 7A is a top view showing the ink head 10 according to the present embodiment.

The ink head 10 according to the present embodiment is different from the ink head 10 of the fourth embodiment, and has a plurality of nozzles for each ink chamber.

The ink head 10 according to the present embodiment has two nozzles 31 arranged for each ink chamber. The ink head 10, similarly to the fourth embodiment, has a first region 51 in the vicinity of the opening of each nozzle 31 in the front surface of a nozzle plate 30. A portion other than the first region 51 is configured as a second region 52. The ink head 10 according to the present embodiment has an ink path 36 formed between the respective first regions 51 of the adjacent two nozzles 31. Note that the ink path 36 uses the same material as the material constituting the second region 52. Therefore, the ink path 36 is included in the second region. For this reason, the ink path 36 retains the put-ink-droplet moved from the first region 51. Alternatively, the ink path 36 turns back put-ink-droplet to the inside of the opening of the nozzle 31. Alternatively, the ink path 36 moves put-ink-droplet to the other portion of the region 52. The ink path 36 can exclude put-ink-droplet from the front surface of the nozzle plate 30.

By the above described composition, even when it has a plurality of nozzles for each ink chamber 20, the ink head 10 can prevent the put-ink-droplet from staying in the vicinity of the opening of the nozzle 31. For this reason, the ink head 10 will prevent a flying deflection of the ink droplet caused by the put-ink-droplet put on the front surface of the nozzle plate. The ink path 36 is formed between the first regions 51 and the adjacent nozzle 31 of each nozzle 31. Therefore the first region 51 of each nozzle 31 can be surrounded by the second region 52. Thereby the ink head 10 more stably prevents the put ink-droplet from staying in the vicinity of the opening of the nozzle 31.

Figure 7B:
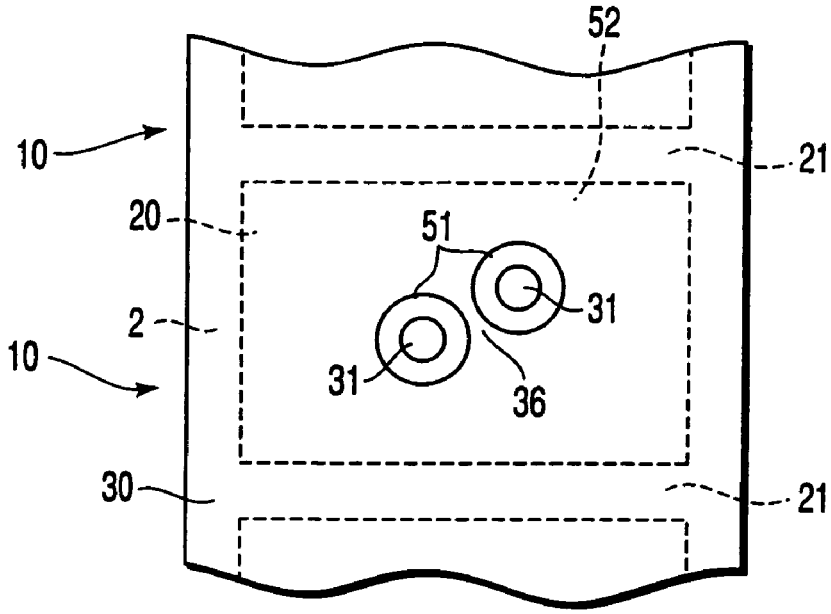
FIG. 7B is a top view showing a modification of the ink head according to the sixth embodiment.

Note that, in the present embodiment, the ink path 36 is configured by reducing portions of the first regions 51 of the nozzles 31 adjacent to each other. If the ink path 36 can be formed by separating the first region 51 of each nozzle 31 from the adjacent first region 51, the ink path 36 can be configured as shown in FIG. 7B. The ink path 36 of FIG. 7B forms the first region 51 of each nozzle 31 in the shape of a doughnut similarly to the fourth embodiment. In this way, when the ink path 36 is arranged between the mutually adjacent nozzles, the shape of the first region to configure the ink path is arbitrary.

(Seventh Embodiment)

Figure 8A:
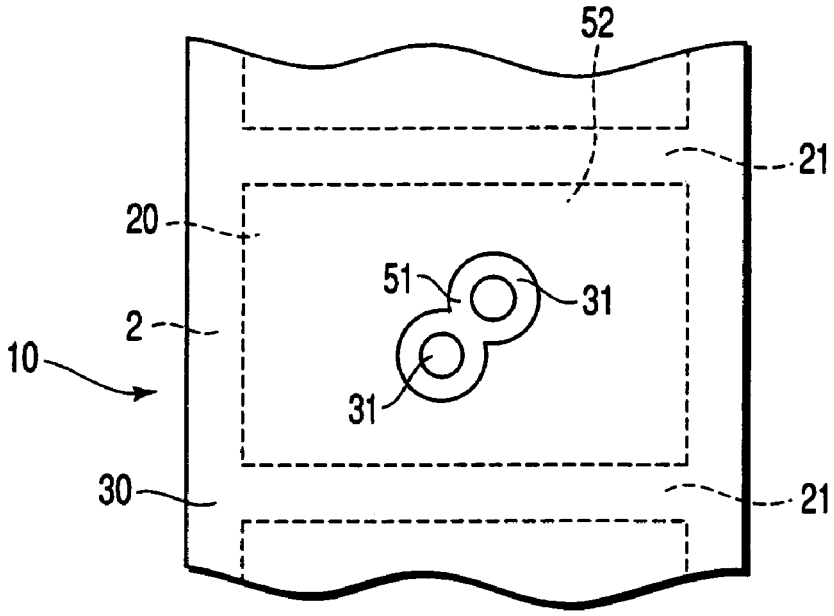
FIG. 8A is a top view showing an ink head according to a seventh embodiment of the present invention.

Hereinafter, an ink head 10 according to a seventh embodiment of the present invention will be described. Note that, in the present embodiment, the same component members as the ink head 10 according to the sixth embodiment of the present invention use the same reference numerals to designate the same component members of this ink head 10 and the detailed description thereof will be omitted. FIG. 8A is a top view showing the ink head 10 according to the present embodiment.

The ink head 10 according to the present embodiment is different from the ink head 10 of the sixth embodiment, wherein the first region 51 of each nozzle 31 and the adjacent first region 51 are continuously configured.

By the above described composition, even when it has a plurality of nozzles 31 for each ink chamber 20, the ink head 10 can prevent the put-ink-droplet from staying in the vicinity of the opening of the nozzle 31. For this reason, the ink head 10 will prevent a flying deflection of the ink droplet caused by the put-ink-droplet put on the front surface of the nozzle plate. Further, the first region 51 of each nozzle 31 and the adjacent first region 51 are continuously configured. Therefore the ink head 10 can process the first region 51 for a plurality of nozzles at one time. Even when the ink head 10 has a plurality of nozzles for each ink chamber 20, the first region 51 can easily is fabricated. And yet the first region 51 can more stably prevent the put-ink-droplet from staying in the vicinity of the opening of the nozzle 31.

Figure 8B:
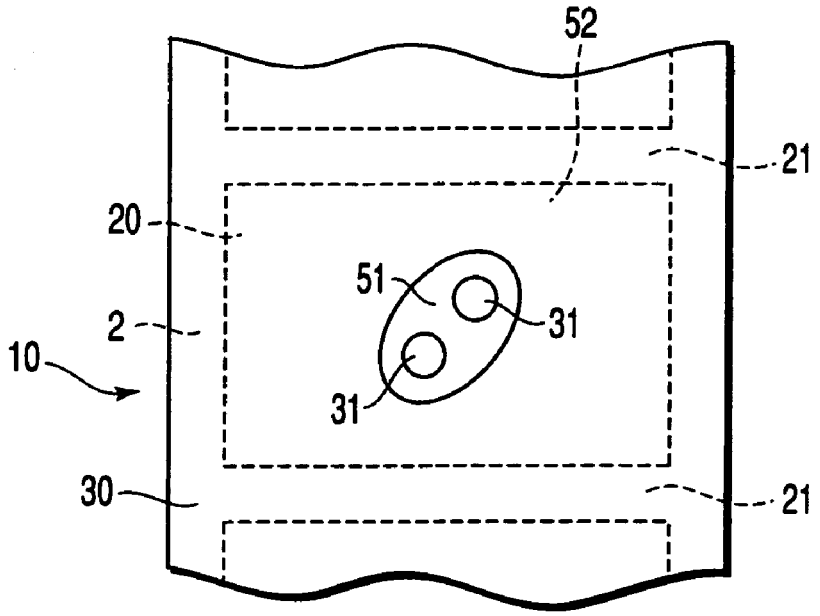
FIG. 8B is a top view showing a modification of the ink head according to the seventh embodiment.
Figure 9A:
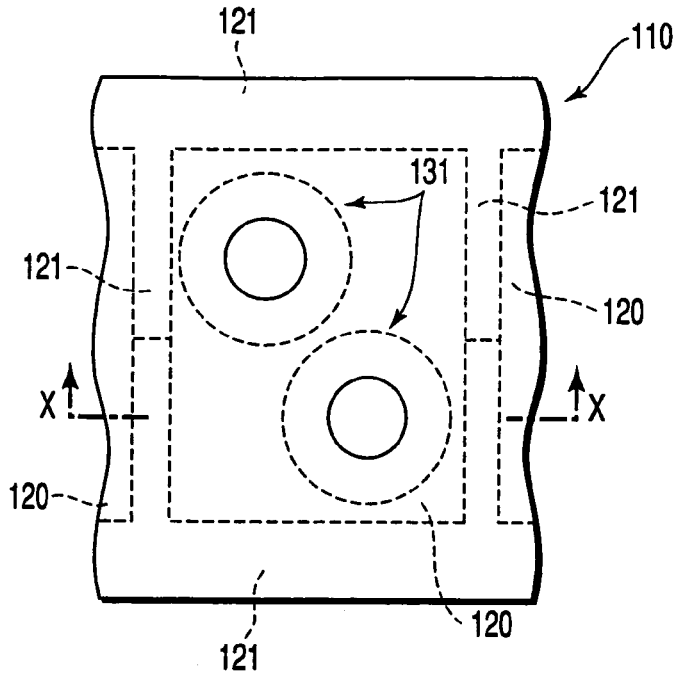
FIG. 9A PRIOR ART
FIG. 9A is a top view showing a portion of a conventional ink head when nozzles are arranged in an ideal state.
Figure 9B:
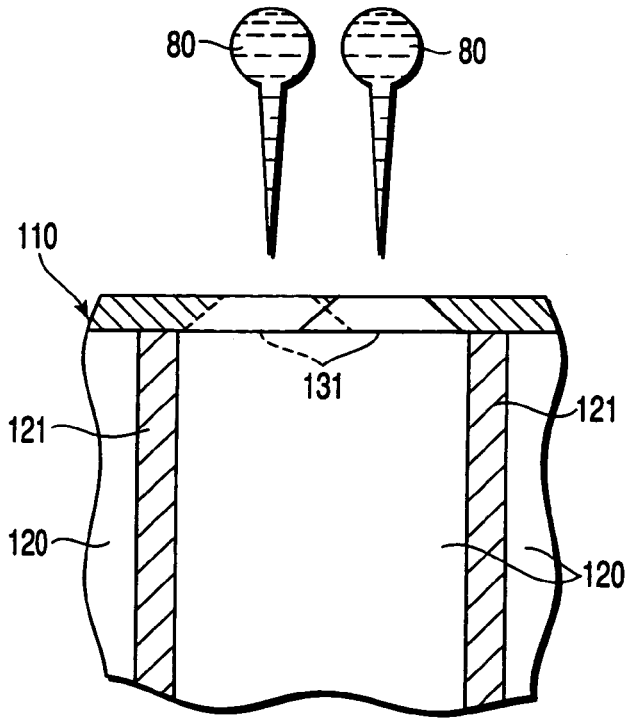
FIG. 9B PRIOR ART
FIG. 9B is a sectional view taken along the line X—X in FIG. 9A.
Figure 10A:
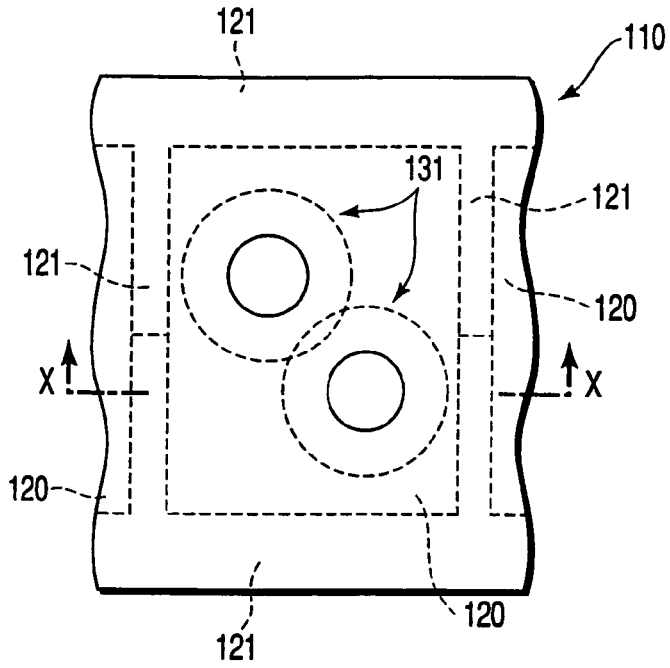
FIG. 10A PRIOR ART
FIG. 10A is a top view showing a portion of the conventional ink head when arrangement of the nozzle is out of the ideal state.
Figure 10B:
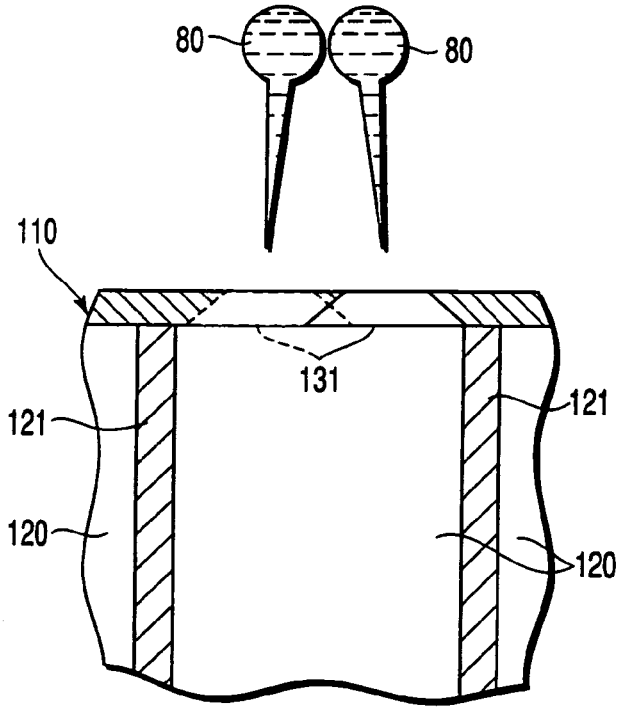
FIG. 10B PRIOR ART
FIG. 10B is a sectional view cut along the line X—X in FIG. 10A.
Figure 11A:
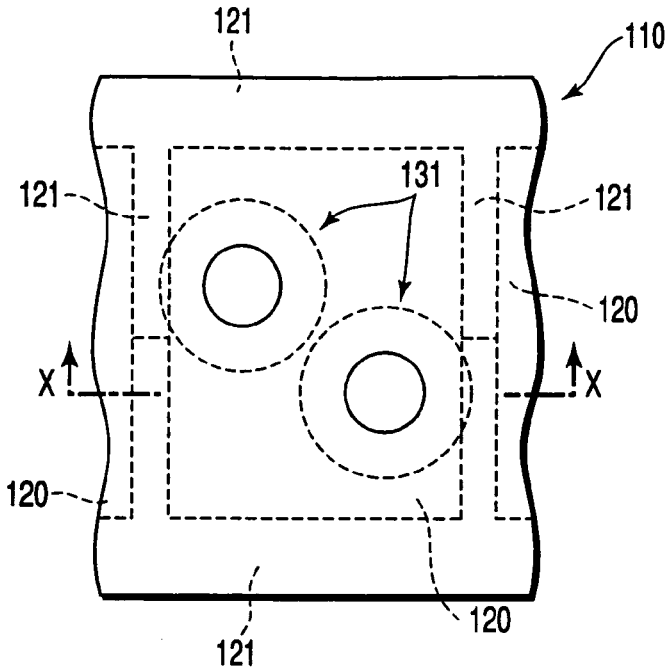
FIG. 11A PRIOR ART
FIG. 11A is a top view showing a portion of the conventional ink head when nozzles are out of the ideal state.
Figure 11B:
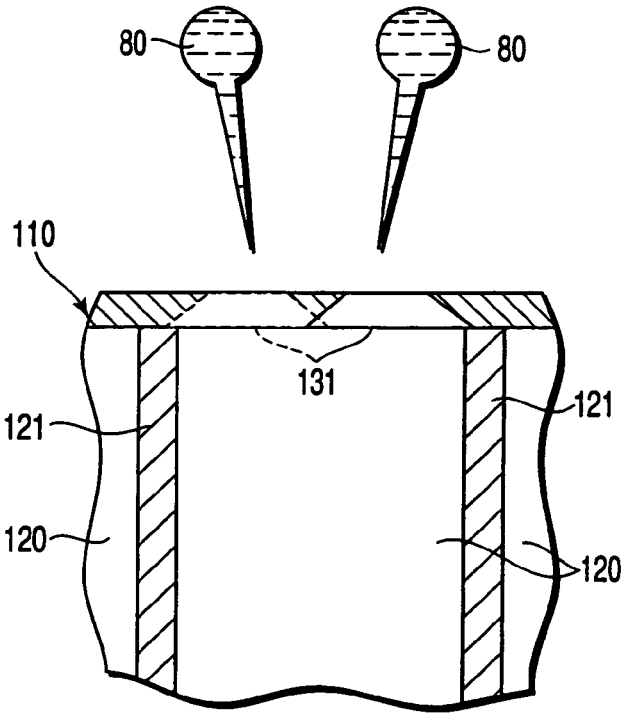
FIG. 11B PRIOR ART
FIG. 11B is a sectional view taken along the line X—X in FIG. 11A.

Note that, in the present embodiment, the first regions 51 form a continuous region in such a manner that the first region of each nozzle 31 in the fourth embodiment is connected to each other in part. The first region 51 is not limited in its shape if only it is formed across a plurality of nozzles 31. As shown in FIG. 8B, it is possible that the first region 51 is configured in the shape so as to be oval in its outer periphery. The first region 51 may be arranged across a plurality of nozzles 31. Of course, the outer periphery of the first region 51 can be configured so as to have a shape such as circular, rectangle, polygon and the like. Nevertheless, it is preferable that the first region 51 is configured so as to be able to smoothly guide the movement of the put-ink-droplet when the put-ink-droplet is moved to the vicinity of the outer periphery.

While several embodiments have been described with reference to the drawings, the present invention is not limited to the above described embodiments, but includes all the embodiments to be practiced within a range without departing from the scope and the spirit of the present invention.

In the present embodiments, an energy generating element which is a piezo element is used as an ejecting energy generating source. However, the ejecting energy generating source is not limited to this. If the ejecting energy generating source generates the ejecting energy necessary to be able to jet the ink, it can be randomly selected.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. At least one ink head in an ink jet printer which forms an image by jetting an ink droplet toward a recording medium and adhering the ink droplet on the recording medium, the ink head comprising:

a) ink chambers arranged at predetermined intervals;

b) jetting energy elements provided in said ink chambers, the jetting energy elements applying a jetting energy to ink in the ink chambers; and c) nozzles provided so as to communicate with said ink chambers, a plurality of the nozzles being provided for each ink chamber, each of plurality of nozzles having a rear-surface-opening which opens in said ink chamber, the rear-surface-opening being oval-shaped, each of the plurality of nozzles being formed such that a minor axial direction of the oval-shaped rear-surface-opening is parallel to the minor axial direction of a nozzle adjacent thereto, and the rear-surface-openings of the nozzles in each ink chamber being arranged so as not to overlap with each other and being separate from each other, wherein said ink chamber has two pairs of side walls opposing each other, and one pair of side walls of the two pairs of side walls is configured so as to be narrower in the interval between one pair of side walls than the other pair of side walls, and each nozzle is arranged so that the minor axial direction of the rear-surface-opening coincides with a side wall arrangement direction of the one pair of side walls, wherein one pair of the two pairs of side walls are provided with the jetting energy elements.

2. The ink head according to claim 1, wherein the jetting energy elements comprise a piezoelectric driving element.

3. The ink head according to claim 2, wherein the rear-surface-opening of each nozzle is separated from any one pair of the two pairs of side walls provided with the piezoelectric driving elements.

* * * * *